US006942257B2

(12) United States Patent
Wong et al.

(10) Patent No.: US 6,942,257 B2
(45) Date of Patent: Sep. 13, 2005

(54) CABINET LATCH

(75) Inventors: Anthony Wong, Franklin, MA (US); Jorge Tomas, Wrentham, MA (US)

(73) Assignee: Cosco Management, Inc., Wilmington, DE (US)

( * ) Notice: Subject to any disclaimer, the term of this patent is extended or adjusted under 35 U.S.C. 154(b) by 215 days.

(21) Appl. No.: 10/162,378

(22) Filed: Jun. 4, 2002

(65) Prior Publication Data

US 2003/0048050 A1 Mar. 13, 2003

Related U.S. Application Data

(60) Provisional application No. 60/322,050, filed on Sep. 13, 2001, now abandoned.

(51) Int. Cl.[7] ..... E05C 19/10
(52) U.S. Cl. ..... 292/128; 292/228
(58) Field of Search ..... 292/95, 121, 122, 292/128, 228, DIG. 4

(56) References Cited

U.S. PATENT DOCUMENTS

| | | | | |
|---|---|---|---|---|
| 1,046,336 A | * | 12/1912 | schatz | 292/114 |
| 3,797,871 A | | 3/1974 | Morishita | |
| 3,850,463 A | * | 11/1974 | Hawkins | 292/67 |
| 3,909,050 A | | 9/1975 | Vicendese et al. | |
| 4,094,541 A | | 6/1978 | Simms | |
| 4,139,249 A | | 2/1979 | Hillman | |
| 4,159,153 A | * | 6/1979 | Yoshikawa | 312/333 |
| 4,182,539 A | * | 1/1980 | Busch | 312/333 |
| 4,416,477 A | | 11/1983 | Bialobrzeski et al. | |
| 4,623,177 A | | 11/1986 | McKinney | |
| 4,632,438 A | | 12/1986 | McKinney | |
| 5,611,579 A | | 3/1997 | Kreitenberg | |
| 5,626,372 A | * | 5/1997 | Vogt | 292/87 |
| 5,645,304 A | | 7/1997 | Richardson et al. | |
| 5,823,649 A | | 10/1998 | Hinrichs | |
| 6,250,694 B1 | * | 6/2001 | Weiland | 292/110 |

OTHER PUBLICATIONS

European Search Report (completed Mar. 17, 2005) for Application EP 02 02 0691 (one page).

Annex to European Search Report (completed Mar. 17, 2005) for Application EP 02 02 0691 (one page).

* cited by examiner

*Primary Examiner*—Gary Estremsky
(74) *Attorney, Agent, or Firm*—Barnes & Thornburg LLP

(57) ABSTRACT

A latch for a cabinet door or drawer for preventing access to the interior of the cabinet or drawer. The latch includes a hook spring biased to engage a catch and that allows the door or drawer to be only slightly opened enough to allow a caregiver to reach the latch and displace it out of the way so that the door or drawer can then be fully opened. When released the latch returns to the biased position. The latch may also disengage the spring so as to be fully disabled and allow the door or drawer to be opened freely.

14 Claims, 4 Drawing Sheets

CABINET LATCH

RELATED APPLICATION

This application claims the benefits of applicant's earlier filed, provisional application Ser. No. 60/322,050 filed Sep. 13, 2001 now abandoned and incorporated herein by reference.

FIELD OF THE INVENTION

This invention relates to latches that prevent young children from gaining access to drawers and cabinets.

SUMMARY OF THE INVENTION

The present invention relates to a latching device that interacts with a catch to prevent a cabinet door or drawer from being opened by a young child such as a toddler or baby. In accordance with one aspect of the invention, the latching device when operative allows the drawer or cabinet door to be opened enough to allow a care giver to insert his/her finger or fingers into the drawer or cabinet and displace the latching device away from the catch so that the drawer or door may be fully opened. When the latching device is released, it returns to its operative position to prevent the door or drawer from being fully opened again once it is closed. Another aspect of the invention is that the latching device may be disabled when child-proofing of the drawer or cabinet is not required.

In one embodiment of the invention the latching device is a hook biased to its operative position by a spring. To open the door or drawer the hook is pushed out of the operative position against the bias of the spring, and when it is released it immediately returns to the operative position so that when the door or drawer is once again closed, it cannot again be opened without manually moving the hook out of the way. However, when the hook is moved to a disabled position the spring does not return the hook to its operative position and the door or drawer may be freely opened and closed.

In accordance with one embodiment of the invention, the movement of the latching device is guided by tracks in a support on which the latching device is mounted. Bosses carried on the latching device register with the tracks on the support and serve as pivots and guides during different phases of the movement of the latching device between its several positions.

DETAILED DESCRIPTION

Figure 5:
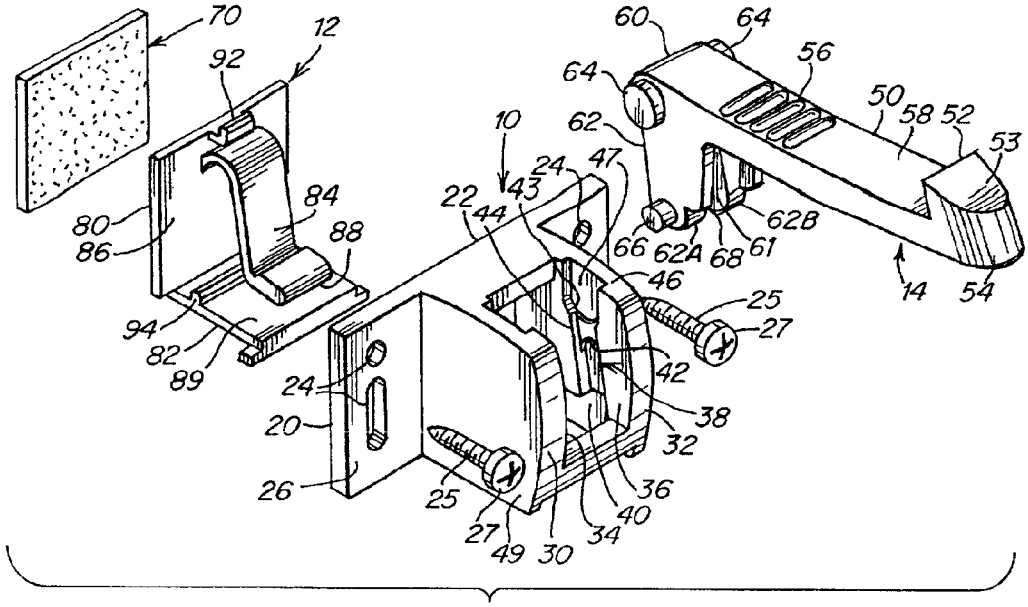
FIG. 5 is an exploded view of the components of the latch shown in FIGS. 1–4.
Figure 10:
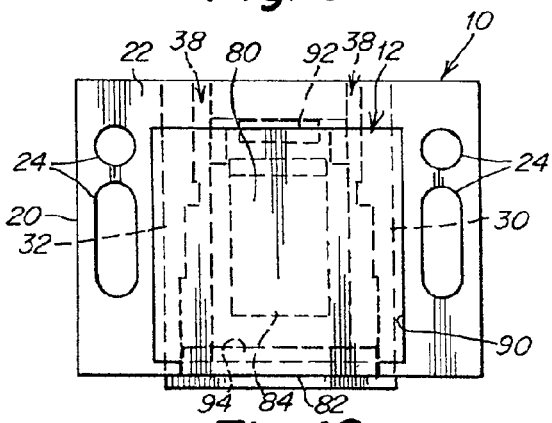
FIG. 10 is a rear elevation view of the back of the latch.

In FIGS. 1–4 one embodiment of a cabinet latch in accordance with this invention is shown mounted in a cabinet C (typically an under-the-counter kitchen cabinet). The latch may function identically and for the same purpose on a cabinet drawer or any other type of closure to prevent a young child from gaining access to the interior of the cabinet. In the illustrated application of the invention the latch is mounted on the inside of door D and cooperates with a catch or cleat L fixed to the cabinet frame F beneath a counter top T and behind the door to limit the extent the door can open without manually displacing the hook of the latch. FIG. 5 is an exploded view of the latch embodiment employed in the cabinet C of FIGS. 1–4. The latch includes a base 10, spring plate 12 and hook 14. The hook 14 engages the catch L to prevent the cabinet door, drawer, or other such closure from being fully opened by a young child and gaining access to the interior.

The base 10 in accordance with one embodiment of the invention includes a mounting plate 20 shown in the illustrated embodiment as a rectangular plate having a generally flat rear surface 22 to enable it to rest flush against the inner surface 23 of the door D and has a pair of openings 24 on each side through which screws 25 or other fasteners may extend to attach the base to the door surface. The lower of the openings 24 on each side preferably are elongated vertically so as to enable the latch to be adjusted while being mounted on the door to insure proper registration between the hook 14 and the catch L. The screws 25 in the upper of the openings 24 may be applied after the proper position of the base is established. The openings 24 may be counter sunk (not shown) in the front surface 26 of the plate 10 so that the heads 27 of the fasteners used to mount the latch are recessed. While the shape of the base 10 and preferred orientation of the openings 24 are described, it should be appreciated that other shapes and orientations of the base and openings may be used as well. The base may be round, elliptical, or polygonal or any other shape, and the screw openings may be other than vertical. However, the longitudinal direction of the openings preferably has a component vertical in the orientation illustrated to facilitate adjustment of the latch with respect to the catch.

In FIG. 5 an adhesive strip 70 is suggested as part of the combination. The adhesive strip is not a necessary element of the combination, but rather is provided for the convenience of the user of the latch when mounting it on a cabinet door or drawer. It will serve to removably retain the assembly in position on the door while the screws 27 are tightened.

The outer surface 26 of the base 20 carries a pair of generally parallel panels 30 and 32 that lie in vertical planes and disposed perpendicular to the base 20. Each of the panels on their opposed surfaces 34 and 36 carry generally L-shaped slots 38 that serve as tracks and are clearly shown in FIGS. 5–9. Each slot 38 includes a lower generally horizontal portion 40, and an upwardly and rearwardly extending portion 44 that connects to the front end 45 of horizontal portion 40 and ends at the upper edge 46 of its respective plate. When the mounting member 10 is secured to the cabinet door D or other support on which it is used, the panels 30 and 32 remain fixed with respect to the door. The opposed slots 38 in the two panels 30 and 32 are parallel to one another. The slots 38 may or may not extend completely through the panels 30 and 32. However, in the preferred form of the invention they do not, so as to reduce the likelihood of one getting his/her fingers pinched by the hook when it moves.

Figure 9:
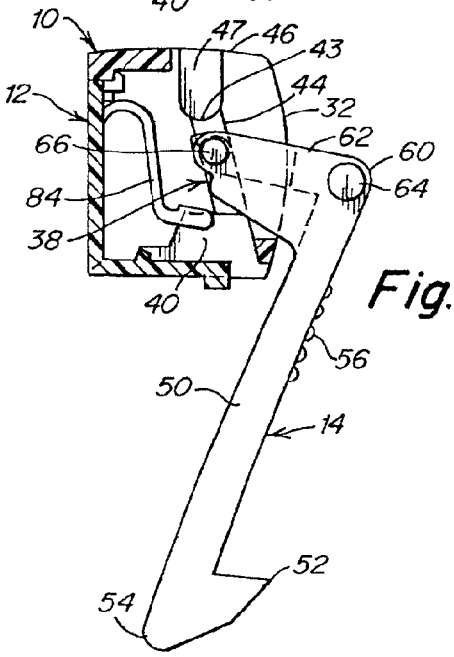

The portion 44 of each slot 38 in accordance with the illustrated embodiment of the invention has stops 42 and 43 across it that may limit the travel of the hook as is explained in more detail below. This arrangement is shown in FIGS. 5 and 9. The slots 38 serve as tracks for bosses 64 and 66 on the rear portion of the hook to control the path of movement of the hook 14 as is also described more fully in the following paragraphs.

Figure 3:
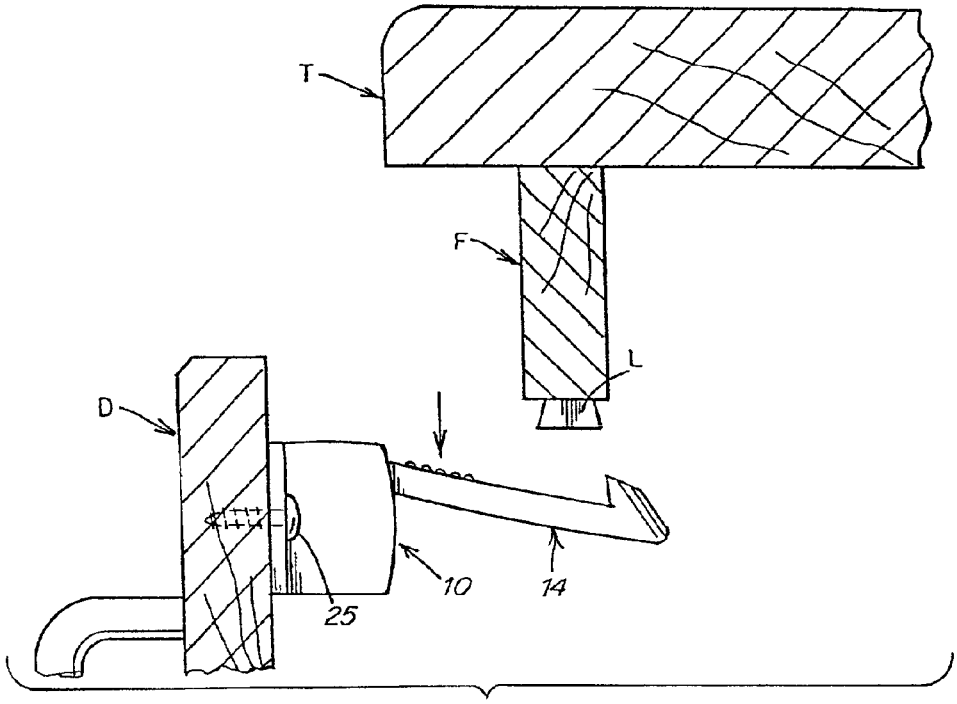
FIG. 3 is a view similar to FIGS. 1 and 2 with the latch moved out of the way to allow the door to open.
Figure 4:
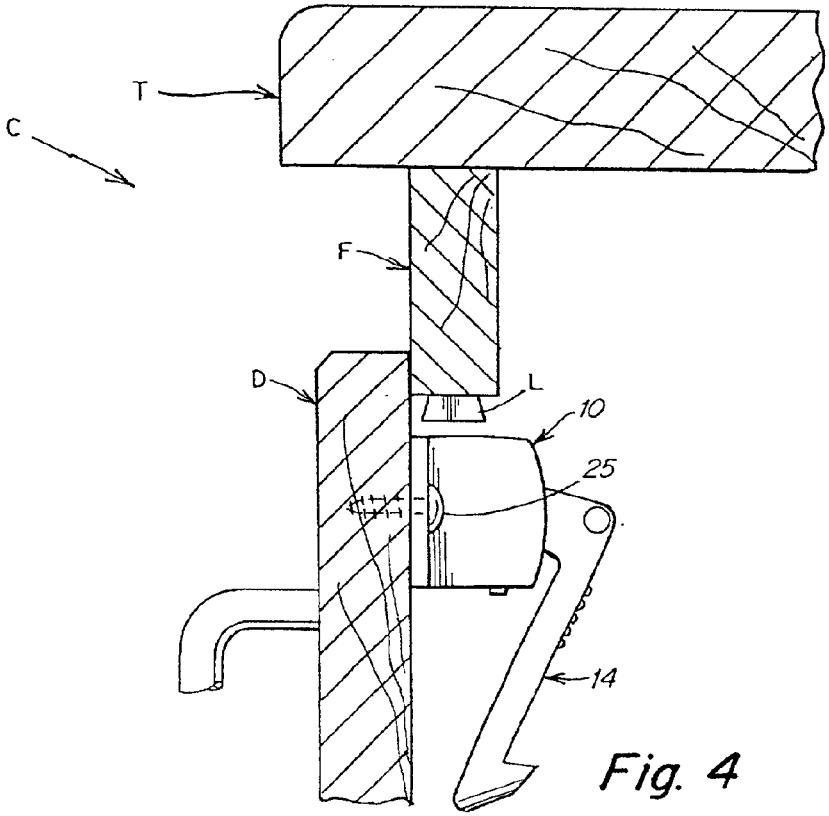
FIG. 4 is a side view of the latch with its hook moved to the disabled or inoperative position.
Figure 11:
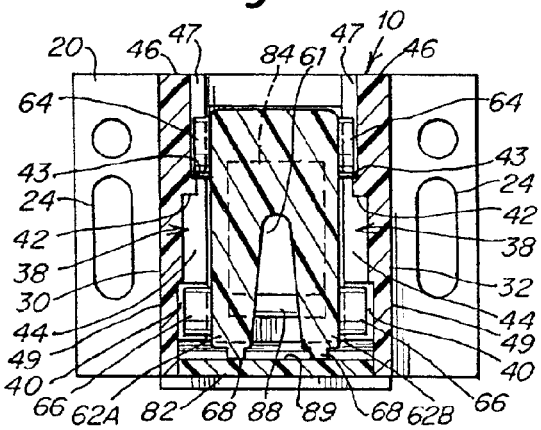
FIG. 11 is a fragmentary cross-sectional view of the latching device taken along sections line 11—11 of FIG. 6.
Figure 6:
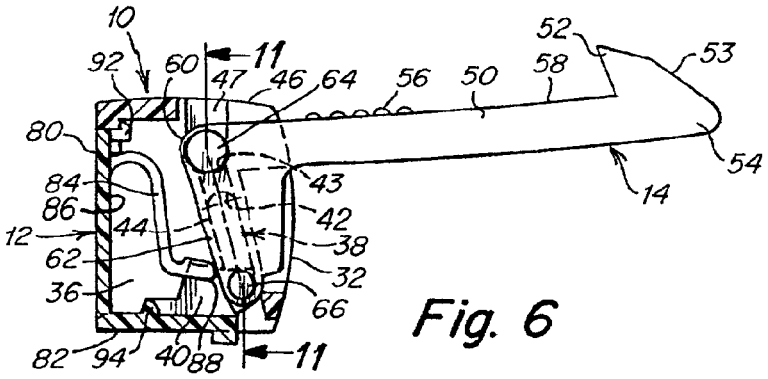
FIGS. 6–9 are fragmentary cross sectional views of the latch in its operative, release, intermediate and disabled positions.
Figure 7:
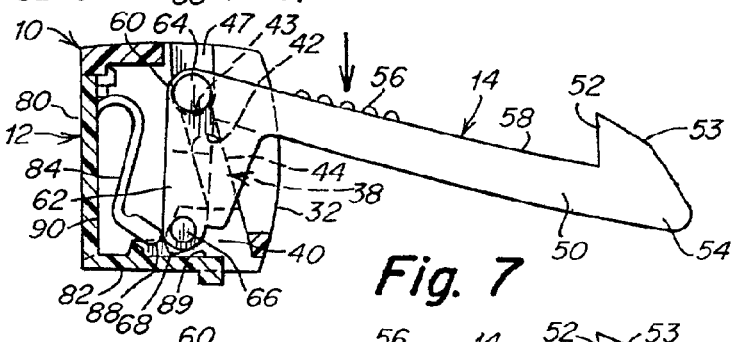

The hook 14 in the embodiment shown in detail in FIG. 5 includes an elongated arm 50 having a barb 52 at its free end 54 and preferably has a finger grip 56 on its upper surface 58 to facilitate movement of the hook from its operative to a deflected or release position as in FIGS. 3 and 7. The hook 14 also includes a small arm 62 connected at its back end 60. A pair of bosses 64 are disposed at the junction of the long and small arms 50 and 62 of the hook, and a second pair of bosses 66 are disposed at the lower, or free end of small arm 62. The arms 50 and 62 in the embodiment illustrated define an angle of approximately 80° between them. The small arm 62 is bifurcated (see FIGS. 5 and 11) by a slot 61 that forms two parallel halves 62A and 62B that are somewhat resilient to create a snap fit of them between the panels 30 and 32 with the bosses 66 in the slots 38. Projections 68 are carried on the ends of the small arm halves 62A and 62B (see FIG. 11). The small arm 62 with the bosses 64 and 66 acts as a trolley enabling the hook to move along the tracks 38 as the hook moves between its operative and disabled positions as fully described below in connection with FIGS. 6–9.

The spring plate 12 in the illustrated embodiment of the invention includes vertical and horizontal segments 80 and 82 and a leaf spring 84 that extends downwardly and away from the front face 86 of the segment 80. The lower edge 88 of the spring 84 is enlarged and disposed above the upper surface 89 of the horizontal segment 82. The vertical wall 80 is mounted in a recess 90 in the rear surface 22 of the mounting plate 20, and the leaf spring 84 extends into the area between the vertical panels 30 and 32 and bears against the bifurcated arm 62 of the hook 14 (see FIGS. 6 and 7). The spring 84 biases the hook to the position shown in FIGS. 1 and 6. Preferably the spring plate 12 including the spring 84 and segments 80 and 82 is molded of a suitable plastic such as acetal as a unitary structure. The hook 14 and base 10 may be molded of a plastic material such as polypropylene. While the spring 84 urges the hook in the operative position shown in FIGS. 1 and 6, the spring 84 may be depressed inwardly toward the vertical segment 80 under the influence of a downwardly directed force on the horizontal arm 50 of the hook as the hook is displaced to the release position of FIGS. 3 and 7. It will be noted in FIGS. 6–9 that the lower wall 82 of the spring plate forms a bottom cover for the base 10 so as to prevent someone from inserting his/her fingers between the panels 30 and 32 and being pinched accidentally between the hook 14 and mounting plate 20 or spring 84.

Figure 1:
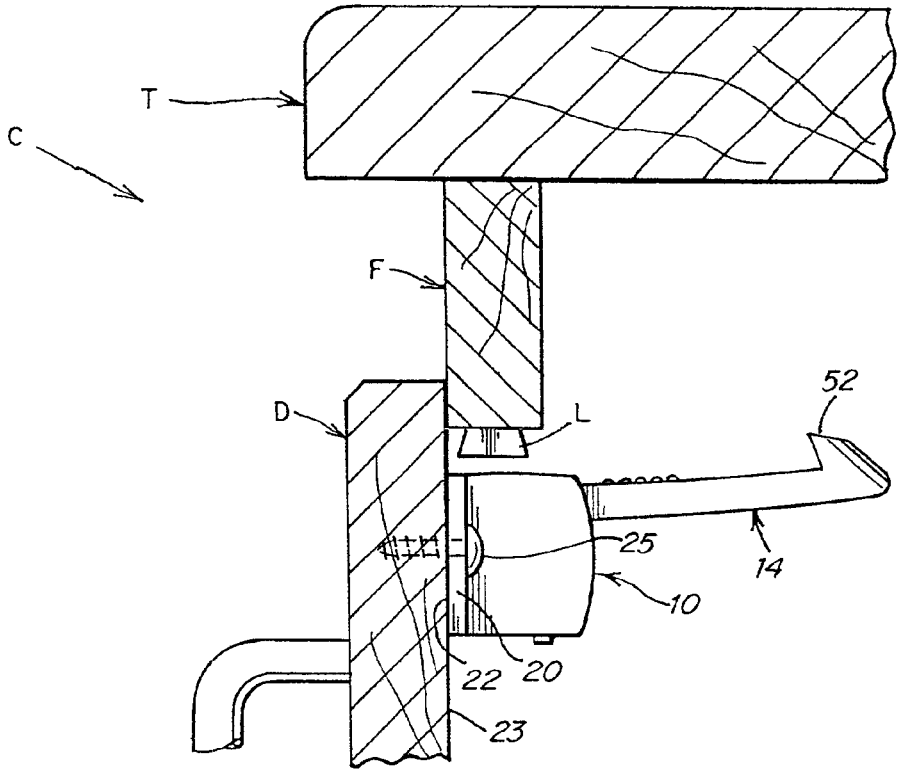
FIG. 1 is a side view showing an embodiment of cabinet latch in accordance with this invention, mounted on a cabinet door and with the latch in the form of a hook in the operative position to prevent the door from being fully opened.
Figure 2:
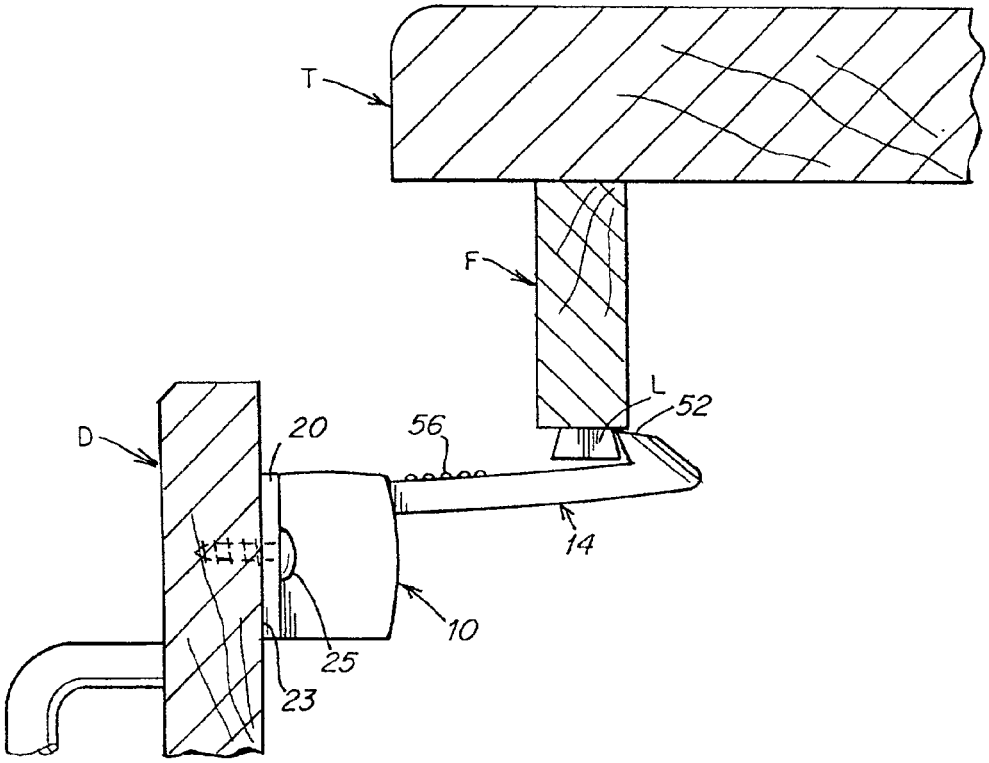
FIG. 2 is a side view similar to FIG. 1 with the door opened slightly to provide access to the interior of the cabinet so as to enable a person to reach into the cabinet and move the latch so as to release the door.

The hook 14 has three positions for performing its function. In FIG. 1 the position of the hook 14 prevents the cabinet door D from being fully opened. However, it does allow the door D to be partially opened as illustrated in FIG. 2, an amount sufficient to provide access to the hook 14 of the latch assembly so that an adult can insert his/her fingers to engage the hook and more particularly the finger grip 56 and lower the barb 52 beneath the catch L so that the door may then be fully opened. The door can be partially open because of the gas between the barb 52 and catch L. The displacement of the hook 14, however, is beyond the motor skills of a baby or young child. The movement of the hook from the position of FIGS. 1, 2 and 6 to the position of FIGS. 3 and 7 is achieved by pivoting the hook on the bosses 64 to cause the lower bosses 66 to move rearwardly in the horizontal portions 40 of the slots 38 against the bias of spring 84 that urges the hook to the position of FIGS. 1, 2 and 6. The bosses 64 are seated in the stops 43 as shown in FIGS. 6 and 7 and therefore the hook 14 is prevented from dropping downwardly in the base 10. The horizontal portion 40 of the slot 38 allows the hook to pivot clockwise as viewed in FIG. 6 about the axis established by the bosses 64. As that occurs, the projections 68 on the ends of the arm halves 62A and 62B slide along the surface of the horizontal segment 82 of the spring plate 12. Once the barb 52 of the hook 14 passes beneath the catch L and the door or drawer is opened, the hook may be released and the door may then be fully opened. The door may thereafter be closed in the normal manner as the barb 52 will slide under the catch by virtue of the cam or ramp 53 on the end of the hook, and the hook will temporarily pivot clockwise and compress the spring 84.

Figure 8:
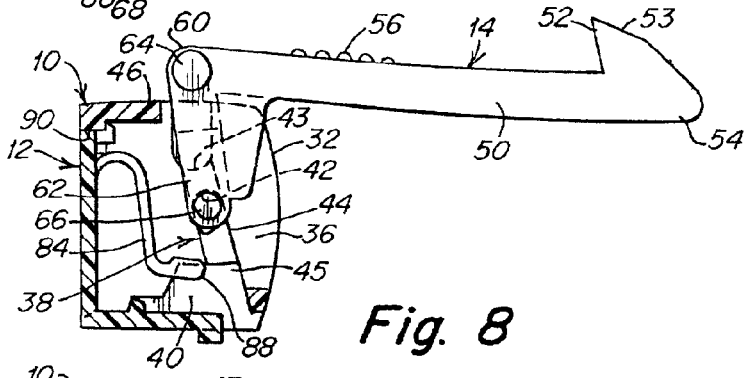

If for any reason it is desired to disable the latch so that the door or drawer on which it is used may be opened freely, the hook may be displaced so that its arm 50 extends downwardly and not engage the catch L. To disable the hook in that fashion, the trolley portion or smaller arm 62 of the hook 14 is raised in the slot 38 from the position of FIG. 6 to that of FIG. 8 so as to free the bosses 64 from the tops of slots 38 as shown in FIG. 8. The stops 42 at the mid-portions of the slots 38 are positioned to engage the bosses 66 and prevent further elevation of the hook. When the bosses 64 are free of the slots as in FIG. 8, the hook may pivot about the bosses 66 held in position by the stops 42 and assume the position of FIGS. 4 and 9. In the raised position of FIG. 8, the spring 84 no longer engages the hook so that it may pivot freely out of the way, as shown and described, and the door D may freely open and close without interference of the latch.

In FIGS. 6–9 the positions of the bosses 64 and 66 in the slots 38 are shown for each position of the hook 14. It will be noted in FIG. 6 that with the arm 50 of the hook 14 in the generally horizontal position, the spring 84 urges the hook to remain in that position by urging the lower bosses 66 toward the front sides of the slot portions 40 and away from the base 20 of mounting plate 10, while the upper bosses 64 remain seated in the stops 43. In FIG. 7 the upper bosses 64 remain seated in the stops 42 while the bosses 66 move rearwardly in the lower portions 40 of the slots 38 against the bias of spring 84, which occurs when a downward pressure is applied on the arm 50 of the hook to pivot it out of the way of the catch L so that the door D may be fully opened. In FIG. 8 the hook 14 is elevated with its bosses 64 above the upper ends of the slots 38 and the arm 62 free of the spring 84 and the bosses 66 engaging the stops 42. The hook is free to pivot about the axis of the bosses 66 retained in position by the stops 42. And finally, in FIG. 9, the hook 14 is shown in the inoperative or disabled position hanging downwardly from the mounting plate 10.

It will be appreciated that when the hook 14 is displaced to the position shown in FIGS. 3 and 7 so as to enable the door or drawer to be fully opened, the hook 14 will remain in the depressed position only so long as a downwardly directed force is applied to the hook. When the force is relieved, that is, when finger pressure is removed from the arm 50, the hook will immediately return to the elevated or fully operative position of FIGS. 1 and 6. As the door is closed, the barb 52 by virtue of its ramp 53 will pass beneath the cleat and the hook will deflect downwardly slightly to allow the barb to again achieve an operative position behind the catch to prevent the door from being fully opened.

It should be appreciated that while one embodiment of the invention has been described in detail, various aspects of the invention may take other forms. For example, while a one piece molded plastic spring plate 12 is described, it will be appreciated that the spring, may be a metal coil spring or any other spring form made of a suitable material and positioned to engage the small arm 62 of the hook, particularly when the hook is in the active position of FIGS. 6 and 7. Also, the spring may act upon other parts of the hook 14 to urge it into the operative position of FIG. 6. Moreover, the means provided for retaining the bosses 66 in the slots 38 may be other than the stops 42. Furthermore, separate slots or tracks may be provided for the upper and lower bosses 64 and 66. Alternatively, the bosses and slots or tracks may be reversed, that is, projections may be provided on the mounting plate 10 that engage tracks in the sides of the hook so as to direct the travel of the hook on the mounting plate. It should also be appreciated that while the latch assembly has been described in accordance with the orientation illustrated, that is, with the hook 14 disposed generally horizontally and pivoting downwardly about horizontal axes, the latch may, for example, be mounted in an inverted position or oriented on its side with the pivotal axes disposed vertically to suit a particular application. It should also be appreciated that the latch of the device need not be L-shaped. Rather, it may be any shape that carries some form of catch for preventing a door or drawer from being fully opened, and that may be readily displaced by a care giver (but not by a young child) to permit the door or drawer to be fully opened. Preferably it is also capable of being disabled so as not to perform its normal function.

Because numerous modifications may be made of the invention, it is not intended that the breadth of the invention be limited to the specific embodiments illustrated and described. Rather, the scope of the invention is to be limited only by the appended claims and their equivalents.

What is claimed is:

1. A latch for releasably locking the door of an enclosure comprising a base having two spaced apart legs and a bight segment therebetween for mounting on the door and movably supporting a first latching member, a second latching member for mounting on the enclosure and mating with the first latching member when said first latching member is in a first position for limiting the extent to which the door may be opened, a spring extending between and engaging said first latching member and said bight segment for biasing said first latching member to said first position, said first latching member being movable to a second position against the bias of the spring so long as a manual force is applied to the first latching member to enable the door to be fully opened, said first member being manually movable to a third position causing the spring to disengage the first latching member so as to disable said latching member.

2. A latch as described in claim 1 wherein tracks and track followers are provided on the two legs and the first latching member to guide movement of the first latching member to the first, second and third positions.

3. A latch as described in claim 2 wherein said tracks are on the support and the followers are on the latching member.

4. A latch as described in claim 1 wherein said first latching member is a hook and the mating member is a cleat.

5. The cabinet latch of claim 1 wherein the bight segment is provided with a portion that is removable from the legs.

6. A latch for releasably locking the door of an enclosure comprising a support for mounting on the door and movably supporting a first latching member, a second latching member for mounting on the enclosure and mating with the first latching member when said first latching member is in a first position for limiting the extent to which the door may be opened, a spring engaging said first latching member and biasing said member to said first position, said first latching member being movable to a second position against the bias of the spring so long as a manual force is applied to the first latching member to enable the door to be fully opened, said first member being manually movable to a third position causing the spring to disengage the first latching member so as to disable said latching member;

wherein tracks and track followers are provided on the support and first latching member to guide movement of the first latching member to the first, second and third positions;

wherein said followers comprise first and second bosses on the first latching member, and said first latching member pivoting on the first bosses when it moves between the first and second position, and said bosses sliding in the tracks while the first bosses are out of the track when the first latching member moves from the second to the third position.

7. A safety latch for preventing young children from opening a cabinet door or drawer comprising, a base having two spaced apart arms and a bight segment extending therebetween for attachment to the door or drawer, a first latching member mounted on the two legs of said base for movement to an operative position allowing the door to be only partially opened, a displaced position allowing the door to be fully opened, and a disabled position, wherein the door may be freely opened and closed, a second latching member mounted on the cabinet and operatively position to engage the first latching member in the operative position and to avoid engagement with the first latching member when in the displaced position and when in the disabled position, and a track means in the two legs of the base and a spring extending between the bight segment and the first latching member enabling said member to move between the operative, displaced and disabled positions.

8. A safety latch as described in claim 7 wherein the first latching member is provided with a follower that rides in the track means.

9. A safety latch as described in claim 8 wherein stops are provided in the tracks means for engaging the followers.

10. A safety latch for drawers and cabinets to prevent access to their interior by young children comprising, a base configured to have two spaced apart side members connected by a bight segment, a latching device slidably and pivotally movable in the legs of the base for engaging a catch on the cabinet to limit the opening of the drawer or cabinet door, a spring extending between the bight segment and the latching device for biasing the latching device to a first position on the base wherein the device is positioned to engage the catch and limit opening of the drawer or cabinet door, said spring enabling the latching device by the application of manual force to pivot from the first position to a second position wherein it does not engage the catch so that the drawer or door may be fully opened and upon the removal of the manual force the spring returning the latching device to the first position, and a stop establishing a second position for the latching device in the base enabling said device to be manually pivoted from the second position to a disabled position wherein it does not interfere with the opening and closing of the drawer or door.

11. A safety latch as described in claim 10 wherein the latching device has a first pair of bosses engaging the side members of the base for establishing a pivot for the latching device when in the first position and a second pair of bosses engaging the side members of the base for establishing a second pivot for the latching device when it is in the second position.

12. A safety latch as described in claim 11 wherein the bosses cooperate with tracks formed in the base.

13. A safety latch for drawers and cabinets to prevent access to their interior by young children comprising, a base, a latching device slidably and pivotally movable in the base for engaging a catch on the cabinet to limit the opening of the drawer or cabinet door, a spring for biasing the latching device to a first position on the base wherein the device is positioned to engage the catch and limit opening of the drawer or cabinet door, said spring enabling the latching device by the application of manual force to pivot from the first position to a second position wherein it does not engage the catch so that the drawer or door may be fully opened and upon the removal of the manual force the spring returning the latching device to the first position, and a stop establishing a second position for the latching device in the base enabling said device to be manually pivoted from the second position to a disabled position wherein it does not interfere with the opening and closing of the drawer or door;

wherein the latching device has a first pair of bosses engaging the base for establishing a pivot for the latching device when in the first position and a second pair of bosses engaging the base for establishing a second pivot for the latching device when it is in the second position;

wherein the bosses cooperate with tracks formed in the base; and wherein the second pair of bosses are out of the tracks when the latching device is in the second position.

14. A safety latch as described in claim 13 wherein the latching device is L-shaped having a short and a long leg, and the first pair of bosses are at junction of the two legs, and the second pair of bosses are at the free end of the shorter leg.

* * * * *